US005238439A

United States Patent [19]

Greene et al.

[11] Patent Number: 5,238,439

[45] Date of Patent: Aug. 24, 1993

[54] MUSICAL BARN

[76] Inventors: Gary Greene, 6306 Custer Rd., Carsonville, Mich. 48419; George Spector, 233 Broadway, New York, N.Y. 10007

[21] Appl. No.: 644,103

[22] Filed: Jan. 18, 1991

[51] Int. Cl.[5] ..... A63H 5/00

[52] U.S. Cl. ..... 446/213; 446/217

[58] Field of Search ..... 446/213, 217, 218, 265; 84/95.1, 94.2

[56] References Cited

U.S. PATENT DOCUMENTS 695,689 3/1902 Leyson ..... 446/213

1,749,804 3/1938 Dugan ..... 446/217 X 4,693,162 9/1987 Lee ..... 446/213 X

*Primary Examiner*—Mickey Yu

[57] ABSTRACT

A miniature musical windmill barn is provided and consists of a housing simulating a miniature barn with louvers covering a mechanical reproducing music mechanism on an elevated platform. A wind wheel exteriorly of the housing on a vertical shaft will rotate the shaft when the wind blows. A structure between the mechanical reproducing music mechanism and the vertical shaft will operate the mechanical reproducing music mechanism by the rotation of the vertical shaft, so that when the wind blows, the music will be mechanically reproduced.

2 Claims, 1 Drawing Sheet

MUSICAL BARN

BACKGROUND OF THE INVENTION

The instant invention relates generally to toy pinwheels and more specifically it relates to a miniature musical windmill barn which provides music when the wind blows.

There are available various conventional toy pinwheels which do not provide the novel improvements of the invention herein disclosed.

SUMMARY OF THE INVENTION

A primary object of the present invention is to provide a miniature musical windmill barn that will overcome the shortcomings of the prior art devices.

Another object is to provide a miniature musical windmill barn that will operate a music box within its housing by the rotation of radial blades of a wind wheel extending upwardly therefrom.

An additional object is to provide a miniature musical windmill barn that will open and close louvers on the housing to vary the sound from the music box.

A further object is to provide a miniature musical windmill barn that is simple and easy to use.

A still further object is to provide a miniature musical windmill barn that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
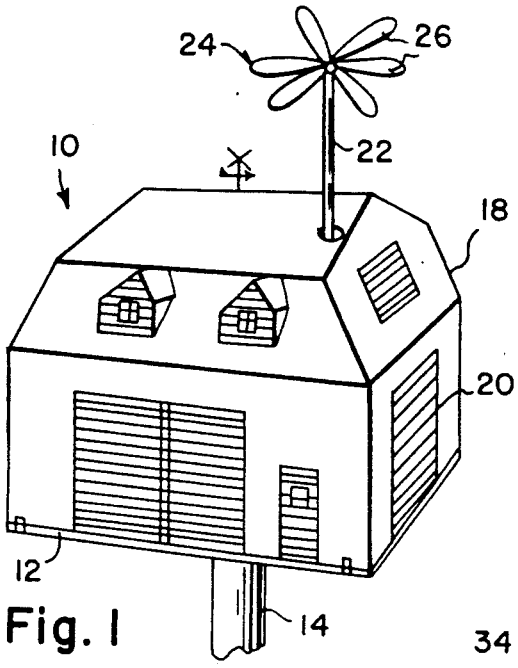
FIG. 1 is a perspective view of the invention.
Figure 2:
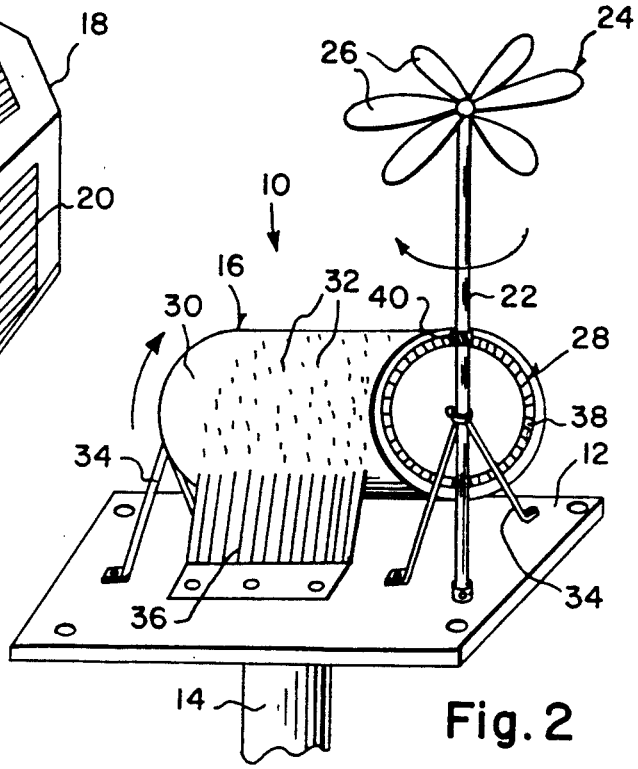
FIG. 2 is a perspective view of the internal mechanism which makes music when the wind rotates the wind wheel.

Turning now descriptively to the drawings, in which similar reference characters denote similar elements throughout the several views, FIGS. 1 and 2 illustrate a miniature musical windmill barn 10 consisting of a platform 12 elevated on a post 14 off the ground. A mechanism 16 is on the platform 12 for mechanically reproducing music. A housing 18 covers the mechanical reproducing music mechanism 16 and simulates a miniature barn having a plurality of louvers 20 thereon to allow the sound of music to exit therefrom. A vertical shaft 22 is rotatably affixed to the platform 12. A wind wheel 24 having a plurality of radial blades 26 is on the vertical shaft 22 exteriorly of the housing 18 for rotating the vertical shaft 22 when the wind blows. A structure 28 is provided between the mechanical reproducing music mechanism 16 and the vertical shaft 22 for operating the mechanical reproducing music mechanism 16 by the rotation of the vertical shaft 22 so that when the wind blows the music will be mechanically reproduced.

The mechanical reproducing music mechanism 16 includes a drum 30 having a pattern of detents 32 upon its circumference. The drum 30 is horizontally rotatably secured to the platform 12 by a pair of spaced apart brackets 34. A vibrating reed member 36 is mounted to the platform 12 to engage with the detents on the drum 30 to produce the music sounds when the drum 30 rotates.

The operating structure 28 includes a face gear 38 on one end of the drum 30. A spur pinion gear 40 is affixed to the vertical shaft 22 and is in engagement with the face gear 38 so that when the vertical shaft 22 rotates the spur pinion gear 40 will turn the face gear 38 along with the drum 30.

Figure 3:
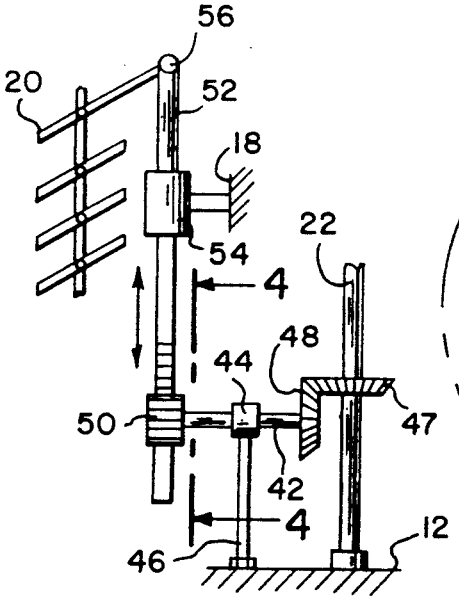
FIG. 3 is a front view of a portion of the internal mechanism of a modification whereby when the wind rotates the wind wheel counterclockwise the louvers will open and when the wind rotates the fan blades clockwise the louvers will close giving less sound with a different muted music effect to indicate the direction of the wind.
Figure 4:
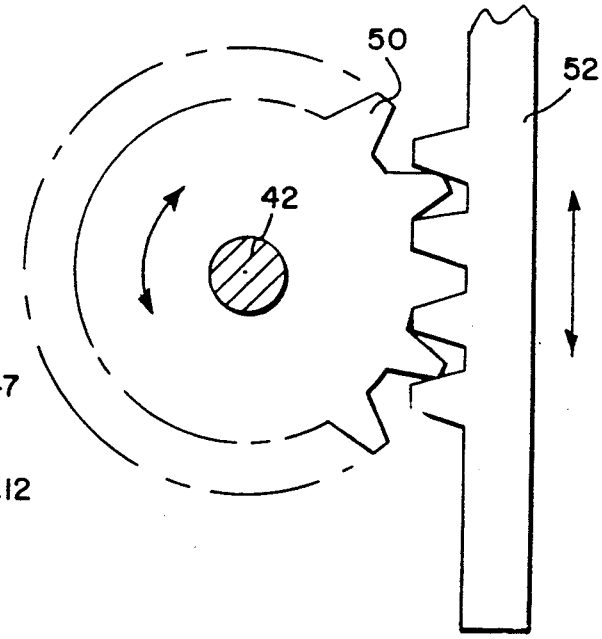
FIG. 4 is a cross sectional view taken along line 4—4 in FIG. 3 showing the rack and pinion gear in cooperation and in greater detail.

FIGS. 3 and 4 show a modification that includes a horizontal rod 42 rotatably supported from the platform 12 by a bearing 44 on an arm 46. A pair of engagable bevel gears 47 and 48 are provided in which one bevel gear 47 is carried on the vertical shaft 22 while the other bevel gear 48 is affixed on one end of the horizontal rod 42. A pinion 50 is affixed on the other end of the horizontal rod 42. A vertical rack 52 is reciprocally supported within the housing 18 in a guide member 54 and is connected at pivot 56 to the louvers 20. When the vertical shaft 22 rotates in one direction the louvers 20 will open and when the vertical shaft 22 rotates in an opposite direction the louvers 20 will close to reduce the amount of the sound of music to exit therefrom to help indicate the direction of the wind operating the wind wheel 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A musical windmill device comprising;

a) an elevated platform;

b) means on said platform for mechanically reproducing music;

c) a housing covering said mechanical reproducing music means, having a plurality of adjustable louvers thereon to allow the sound of music to emit therefrom;

d) a vertical shaft rotatably affixed to said platform;

e) a wind wheel having a plurality of radial blades on said vertical shaft exteriorly of said housing for rotating said vertical shaft in opposite directions responsive to wind direction;

f) means between said mechanical reproducing music means and said vertical shaft, for operating said mechanical reproducing music means by the rotation of said vertical shaft so that when the wind blows the music will be mechanically reproduced;

g) means responsive to shaft rotation for closing and opening said louvers to vary the music volume emanating from the louvers in accordance with wind direction.

2. A device as recited in claim 1, wherein the last said means comprises a gear on said shaft engaging another gear on a horizontal shaft mounted on said platform in further combining with a pinion driven by said horizontal shaft in operative engagement with a rack pivotly connected to said adjustable louvers.

* * * * *